US006019217A

United States Patent [19]

Melan et al.

[11] Patent Number: 6,019,217

[45] Date of Patent: Feb. 1, 2000

[54] PACKAGING CONTAINER FOR LARGE-CALIBER AMMUNITION

[75] Inventors: Martin Melan, Celle; Stefan Thiesen, Willich, both of Germany

[73] Assignee: Rheinmetall W & M GmbH, Unterlüss, Germany

[21] Appl. No.: 09/186,185

[22] Filed: Nov. 5, 1998

[30] Foreign Application Priority Data

Nov. 5, 1997 [DE] Germany ..... 197 48 829

[51] Int. Cl.[7] ..... F42B 39/00

[52] U.S. Cl. ..... 206/3

[58] Field of Search ..... 206/3, 317, 586, 206/594; 89/34, 36.01, 36.05

[56] References Cited

U.S. PATENT DOCUMENTS

| | | | |
|---|---|---|---|
| 4,004,684 | 1/1977 | Scollins | 206/3 |
| 4,667,816 | 5/1987 | Osborne | 206/3 |
| 4,722,436 | 2/1988 | Moraine | 206/3 |
| 5,779,031 | 7/1998 | Moraine et al. | 206/3 |

FOREIGN PATENT DOCUMENTS 195 14 988 10/1996 Germany .

*Primary Examiner*—David T. Fidei

*Attorney, Agent, or Firm*—Venable; Gabor J. Kelemen

[57] ABSTRACT

A packaging container for cartridge ammunition includes a box for accommodating the cartridge ammunition and an adapter sleeve disposed in the box and having a rear portion formed as a centering sleeve for surrounding a rearward sabot flange of the cartridge ammunition when situated in the packaging container. The rear portion of the adapter sleeve is affixed to an inner wall of the box. The adapter sleeve further has a forwardly conically tapering front portion having a frontal terminus for engaging a rearwardly oriented side of a frontal sabot flange of the cartridge ammunition when situated in the packaging container. The front portion of the adapter sleeve is provided with elongated apertures oriented along the box length and extending to and breaking through the frontal terminus for dividing the front portion of the adapter sleeve into radially resilient fingers.

4 Claims, 2 Drawing Sheets

PACKAGING CONTAINER FOR LARGE-CALIBER AMMUNITION

BACKGROUND OF THE INVENTION

The invention relates to a packaging container for large-caliber ammunition formed of a thin-walled cartridge (propellant case) having a cartridge bottom and a sabot projectile extending from the cartridge. Between the flanges of the sabot and the inner wall of the packaging container an adapter sleeve is arranged which engages the frontal flange of the sabot.

A packaging container of the above-outlined type is described in German Offenlegungsschrift (application published without examination) No. 195 14 988. The packaging container is formed of a cylindrical support envelope (box) which may be closed at its end faces. To ensure a firm seating of the sabot projectile within the packaging container, between the frontal and the rearward sabot flanges as well as the inner wall of the packaging container, an adapter sleeve is arranged which is formed of two halves and which engages both the frontal and the rearward flange of the sabot.

For preventing an unintentional displacement of the cartridge within the packaging container in the direction of the projectile tip, in the front of the known packaging container an insertion sleeve having a stop is provided. A displacement of the relatively heavy projectile in the direction of the cartridge bottom of the ammunition is prevented by immobilizing the adapter sleeve by at least one replaceable pin which extends behind the adapter sleeve transversely to the packaging container.

It is, among others, a disadvantage of the above-outlined known packaging container that the introduction of the adapter sleeve and its immobilization by means of a pin or pins are relatively time-consuming procedures.

SUMMARY OF THE INVENTION

It is an object of the invention to provide an improved packaging container of the above-outlined type in which the cartridge ammunition accommodated therein is securely supported and may nevertheless be rapidly introduced into and rapidly removed from the container.

This object and others to become apparent as the specification progresses, are accomplished by the invention, according to which, briefly stated, the packaging container for cartridge ammunition includes a box for accommodating the cartridge ammunition and an adapter sleeve disposed in the box and having a rear portion formed as a centering sleeve for surrounding a rearward sabot flange of the cartridge ammunition when situated in the packaging container. The rear portion of the adapter sleeve is affixed to an inner wall of the box. The adapter sleeve further has a forwardly conically tapering front portion having a frontal terminus for engaging a rearwardly oriented side of a frontal sabot flange of the cartridge ammunition when situated in the packaging container. The front portion of the adapter sleeve is provided with elongated apertures oriented along the box length and extending to and breaking through the frontal terminus for dividing the front portion of the adapter sleeve into radially resilient fingers.

The invention is essentially based on the principle to fixedly attach the adapter sleeve to the inside of the packaging container before introducing the cartridge ammunition thereinto without giving rise to subsequent problems during the introduction of the cartridge into or its removal from the packaging container. This is achieved according to the invention by providing in the adapter sleeve a plurality of apertures extending in the longitudinal direction of the packaging container; the apertures extend up to and break through the forward end of the adapter sleeve and thus render the frontal length portion of the adapter sleeve radially resilient. By virtue of such a resilient effect, the adapter sleeve encloses the rearward region of the frontal sabot flange of the projectile sabot and prevents a displacement of the projectile in the direction of the cartridge bottom in case of impacts.

In contrast to known adapter sleeves, the adapter sleeve of the packaging container according to the invention may be a single-piece construction which permits a rapid and safe assembly of the packaging container.

In practice, polyamide 66 (66 NYLON) was found to be particularly advantageous as the material for the adapter sleeve.

DESCRIPTION OF THE PREFERRED EMBODIMENT

Figure 1:
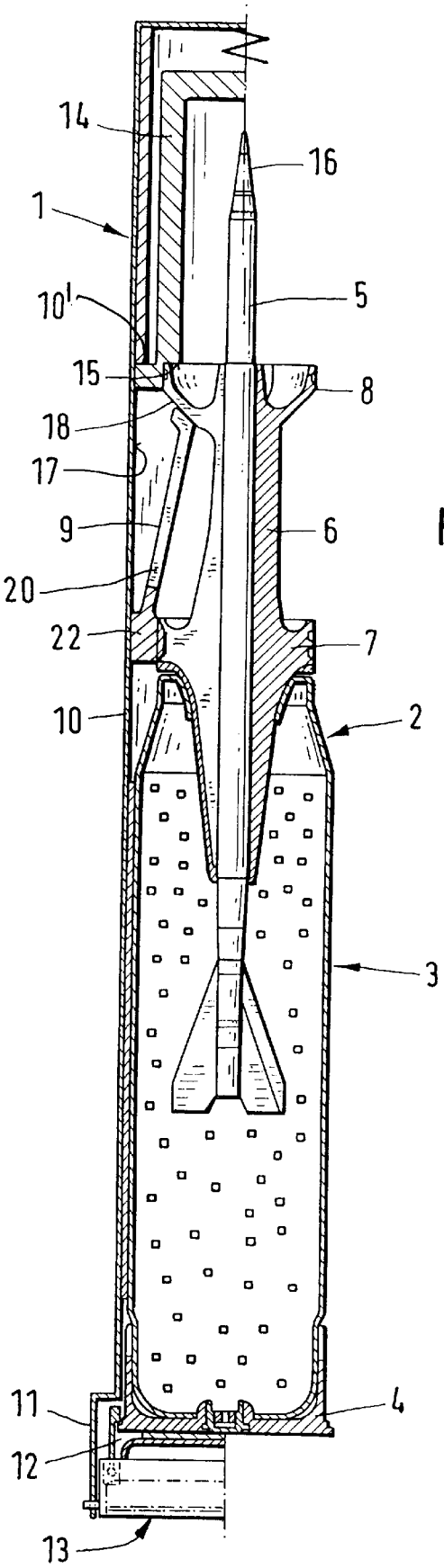
FIG. 1 is a sectional elevational view of one longitudinal half of the packaging container, including an adapter sleeve, accommodating a large-caliber cartridge ammunition according to a preferred embodiment of the invention. The other longitudinal half which is a mirror image of the illustrated first longitudinal half is not shown.

FIG. 1 shows a packaging container 1 accommodating a cartridge ammunition 2 including a propellant case 3 having a cartridge bottom 4 as well as a subcaliber projectile 5 having a sabot 6. Between the rear and front sabot flanges 7 and 8 of the sabot 6 a one-piece adapter sleeve 9 is provided which is made of a plastic material, preferably polyamide 66.

The packaging container 1 includes a box 10, whose rearward end 11 has an opening 12 through which the cartridge ammunition 2 may be introduced into and removed from the container 1 and which may be closed by a lid-like closure portion 13.

The packaging container 1 further includes an inner insertion sleeve 14 which is located at the frontal end of the box 10 and abuts a shoulder 10' formed on the inner wall 17 of the box 10. The insertion sleeve 14 has an abutment edge 15 for abutting the frontal edge of the forward flange 8 of the sabot 6 to thus absorb forwardly directed axial forces exerted on the cartridge ammunition. Such forces are generated, for example, when the packaging container 1 is dropped in the forward direction.

The adapter sleeve 9 has a rearward end portion 22 formed in the zone of the rearward flange 7 of the sabot 6 and acting as a centering sleeve for the cartridge ammunition 2. The rearward portion 22 is fixedly connected with the inner wall 17 of the packaging container 1. Further, the front end of the adapter sleeve 9 engages the rear side 18 of the frontal sabot flange 8. The adapter sleeve 9, by virtue of its structure and arrangement, prevents the entire weight of the projectile 5 from acting only on the propellant case 3 should the packaging container 1 be dropped in the direction of the cartridge bottom 4. Rather, in case of such an impact, the adapter sleeve 9, as a result of its engagement with the rear side 18 of the frontal sabot flange 8, takes up a substantial part of the impact forces and transfers them to the box 10.

Figure 2:
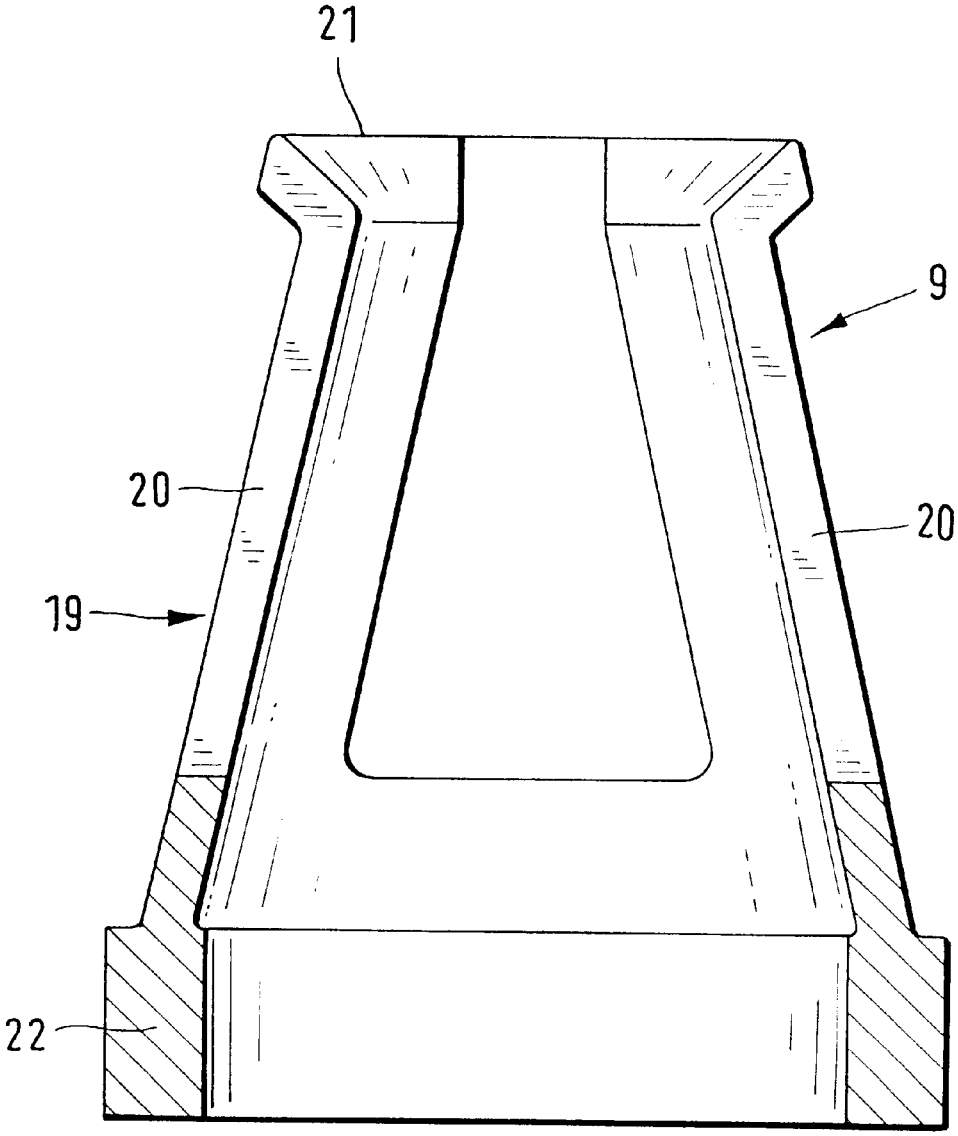
FIG. 2 is an enlarged sectional view of the adapter sleeve shown in FIG. 1.

Also referring to FIG. 2, to permit an introduction into as well as a removal of the cartridge 2 from the packaging container 1 without the need of first removing the adapter sleeve 9, in the conically tapering region 19 of the adapter sleeve 9 length-wise oriented slot-like apertures 20 are provided which extend up to and break through the frontal end 21 of the adapter sleeve 9 to thus divide the conically tapering region 19 of the adapter sleeve 9 into radially resilient, circumferentially arranged, finger-like sections which resiliently yield when forced radially apart by the frontal sabot flange 8 upon insertion or removal of the cartridge ammunition.

It will be understood that the above description of the present invention is susceptible to various modifications, changes and adaptations, and the same are intended to be comprehended within the meaning and range of equivalents of the appended claims.

What is claimed is:

1. A packaging container for cartridge ammunition having a propellant case and a sabot projectile provided with frontal and rearward sabot flanges; said packaging container comprising (a) a box for accommodating the cartridge ammunition; said box having an inner wall and a length; and (b) an adapter sleeve disposed in said box and having (1) a rear portion formed as a centering sleeve for surrounding the rearward sabot flange and for centering the cartridge ammunition when situated in said packaging container; said rear portion of said adapter sleeve being affixed to said inner wall of said box; and (2) a forwardly conically tapering front portion having a frontal terminus for engaging a rearwardly oriented side of the frontal sabot flange when the cartridge ammunition is situated in said packaging container; said front portion of said adapter sleeve being provided with elongated apertures oriented along the box length and extending to and breaking through said frontal terminus for dividing said front portion into radially resilient fingers.

2. The packaging container as defined in claim 1, further comprising an abutment formed on said inner wall of said box for abutting a front edge of the frontal sabot flange when the cartridge ammunition is situated in said packaging container.

3. The packaging container as defined in claim 1, wherein said adapter sleeve is a one-piece component.

4. The packaging container as defined in claim 1, wherein said adapter sleeve is of polyamide 66.

* * * * *